US006513627B1

(12) United States Patent
Cruise et al.

(10) Patent No.: US 6,513,627 B1
(45) Date of Patent: Feb. 4, 2003

(54) DEEP LEVEL MINE SHAFT HYBRID CONVEYANCE SYSTEM

(76) Inventors: Rupert John Cruise, 18 Coloretto, 16 Bompas Road, Dunkeld West, Johannesburg 2196 (ZA); Charles Farrell Landy, 13 Mendelsohn Avenue, Glendower, Edenvale, Johannesburg 1609 (ZA)

( * ) Notice: Subject to any disclaimer, the term of this patent is extended or adjusted under 35 U.S.C. 154(b) by 0 days.

(21) Appl. No.: 09/786,383

(22) PCT Filed: Feb. 9, 1999

(86) PCT No.: PCT/IB99/01499

§ 371 (c)(1),
(2), (4) Date: Jul. 18, 2001

(87) PCT Pub. No.: WO00/14006

PCT Pub. Date: Mar. 16, 2000

(30) Foreign Application Priority Data

Sep. 4, 1998 (ZA) ..... 98/8114

(51) Int. Cl.[7] ..... B66B 11/04
(52) U.S. Cl. ..... 187/289; 187/258
(58) Field of Search ..... 187/251, 258, 187/404, 406, 407, 408, 412, 289, 411; 414/222.07, 222.11, 427, 458, 459, 561, 592; 299/95; 310/12

(56) References Cited

U.S. PATENT DOCUMENTS

| | | | | | |
|---|---|---|---|---|---|
| 4,570,753 | A | * | 2/1986 | Ohta et al. | 187/251 |
| 5,086,881 | A | * | 2/1992 | Gagnon et al. | 104/290 |
| 5,195,615 | A | * | 3/1993 | Manning | 187/251 |
| 5,299,662 | A | * | 4/1994 | Reddy et al. | 187/94 |
| 5,509,503 | A | * | 4/1996 | Salmon | 187/266 |
| 5,625,174 | A | * | 4/1997 | Ito et al. | 187/250 |
| 5,816,368 | A | * | 10/1998 | Barrett et al. | 187/249 |
| 5,921,351 | A | * | 7/1999 | Schroder-Brumloop | 187/255 |

FOREIGN PATENT DOCUMENTS

| | | | |
|---|---|---|---|
| EP | 0254840 | 2/1988 | B66F/7/04 |
| JP | 1220691 | 9/1989 | B66B/9/06 |
| JP | 9142742 | 6/1997 | B66B/1/14 |

* cited by examiner

*Primary Examiner*—Jonathan Salata
(74) *Attorney, Agent, or Firm*—James Ray & Associates

(57) ABSTRACT

A conveyance system is provided which includes a conveyance for conveying cargo and guide to which the convenience is displaceably mounted for guiding displacement of the conveyance. The system further includes a winding element connected via a cable to the conveyance and a linear motor for at least assisting displacement of the conveyance along a portion of the guide.

14 Claims, 3 Drawing Sheets

DEEP LEVEL MINE SHAFT HYBRID CONVEYANCE SYSTEM

Figure 1:
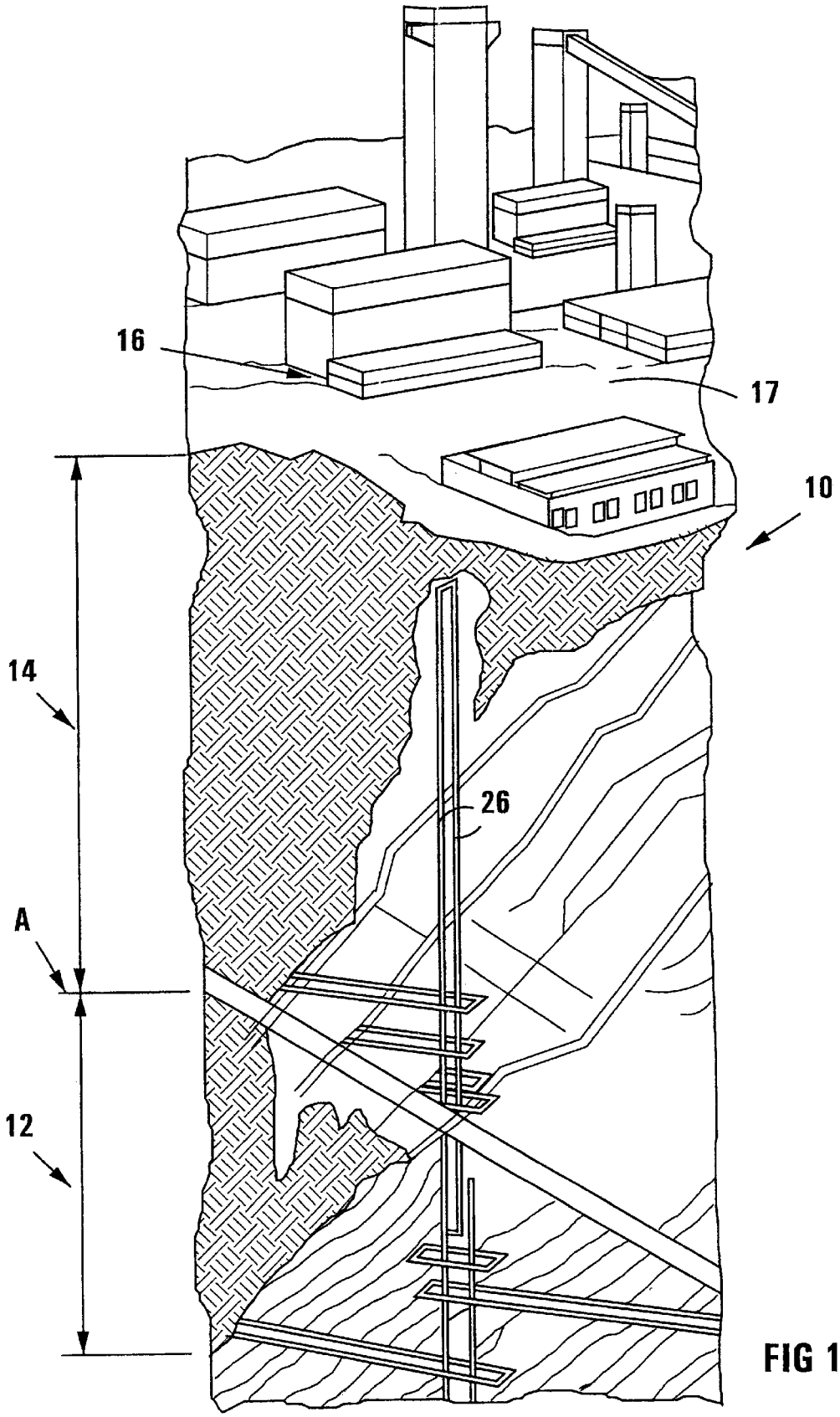

THIS INVENTION relates to a deep-level mine conveyance system. It also relates to a method of reducing tension in a cable of a deep-level mine shaft conveyance system.

Traditional conveyance systems, such as cable hoisting arrangements used in mining operations, typically include a drive or winding mechanism which operatively hoists a skip or cage via a rope or cable. The drive mechanism is normally surface mounted and the cage and its load are supported by the rope and, accordingly, in order to hoist heavy loads from a substantial depth a rope with a large cross-sectional area is required. The large cross-sectional area results in a heavier rope resulting in further disadvantages, e.g a restriction in the maximum depth from which the load can be hoisted. Linear conveyance systems which include linear synchronous motors are disclosed in JP 09 142742 A (TODA CONSTR CO LTD), JP 01 220691 (MITSUBISHI ELECTRIC CORP), U.S. Pat. No. 5,195,615 A (MANNING MICHAEL J N) and EP 0 254 840 A (GEBAUER AG). It is however to be noted that these inventions use friction winders which operate on a counterweight principle in dual shaft configuration and are generally not suitable for deep-level mining operations i.e. for mine shafts deeper than about 1500 m.

According to the invention, there is provided a deep-level mine shaft conveyance system which includes,

- a conveyance for conveying cargo;
- a linear motor including a guide member carrying stator windings, the guide member being mounted in use in a mine shaft in its lower end region which is at a depth in excess of 1500 m, and a reaction member mounted to the conveyance for displacement along the guide member by electromagnetic forces;
- a hoisting cable in excess of 1500 m in length and anchored at its lower end to the conveyance;
- electrical winding means including a drum, the hoisting cable being anchored at its upper end to the drum and being wound and unwound around the drum to displace the conveyance along the mine shaft, the linear motor at least assisting displacement of the conveyance in the lower end region.

The system may include two linear motors, reaction members of the linear motors being mounted on opposed sides of the conveyance and guide rails carrying stator windings associated with the reaction members being provided in use on opposed sides of the mine shaft.

Typically, the conveyance is shaped and dimensioned to convey personnel in underground mining operations and includes mounting means for mounting the winding means proximate a ground surface of the mine shaft and mounting the guide means along a mine shaft. The winding means is typically configured for operation in single shaft deep mining applications.

The conveyance and/or the guide means and/or the winding means are typically substantially similar to a conventional drum hoisting arrangement used in mining operations. Likewise, the linear motor may be a linear synchronous motor arranged in a conventional fashion.

The guide means are typically in the form of guide rails which extend substantially vertically, when installed, at least along the lower end region of the mine shaft. The linear motor is preferably mounted along a lower end region of the guide rails.

The system typically includes a controller for controlling operation of the linear motor and the winding means.

Typically, the controller is operable to disable the linear motor when the conveyance is above a predetermined position along the guide means, typically the position is between about 75% to about 80% down the mine shaft. When the conveyance is below the predetermined position, the controller may be operable to enable the linear motor and control operation of the winding means to reduce tension in the cable. In certain embodiments, the controller is operable to support the conveyance and its load in such a fashion so that it is partially supported by both the linear motor and the cable hoisting arrangement.

Preferably, the controller is arranged to activate the linear motor at least to assist in braking the conveyance at substantial depth, accelerating the conveyance at substantial depth, or the like.

The linear motor may include a primary winding arrangement mounted along the guide means, and a secondary magnet arrangement mounted to the conveyance, which is typically a lift cage or the like.

Further in accordance with the invention, there is provided a method of reducing tension in a cable of a deep-level mine shaft conveyance system which includes electrical winding means to which the cable is anchored, the method including activating a linear motor mounted to guide rails and to a conveyance of the system at least partially to inhibit downward displacement of the conveyance and thereby reduce the tension in the cable.

The invention is now described, by way of example, with reference to the accompanying diagrammatic drawings.

Figure 2:
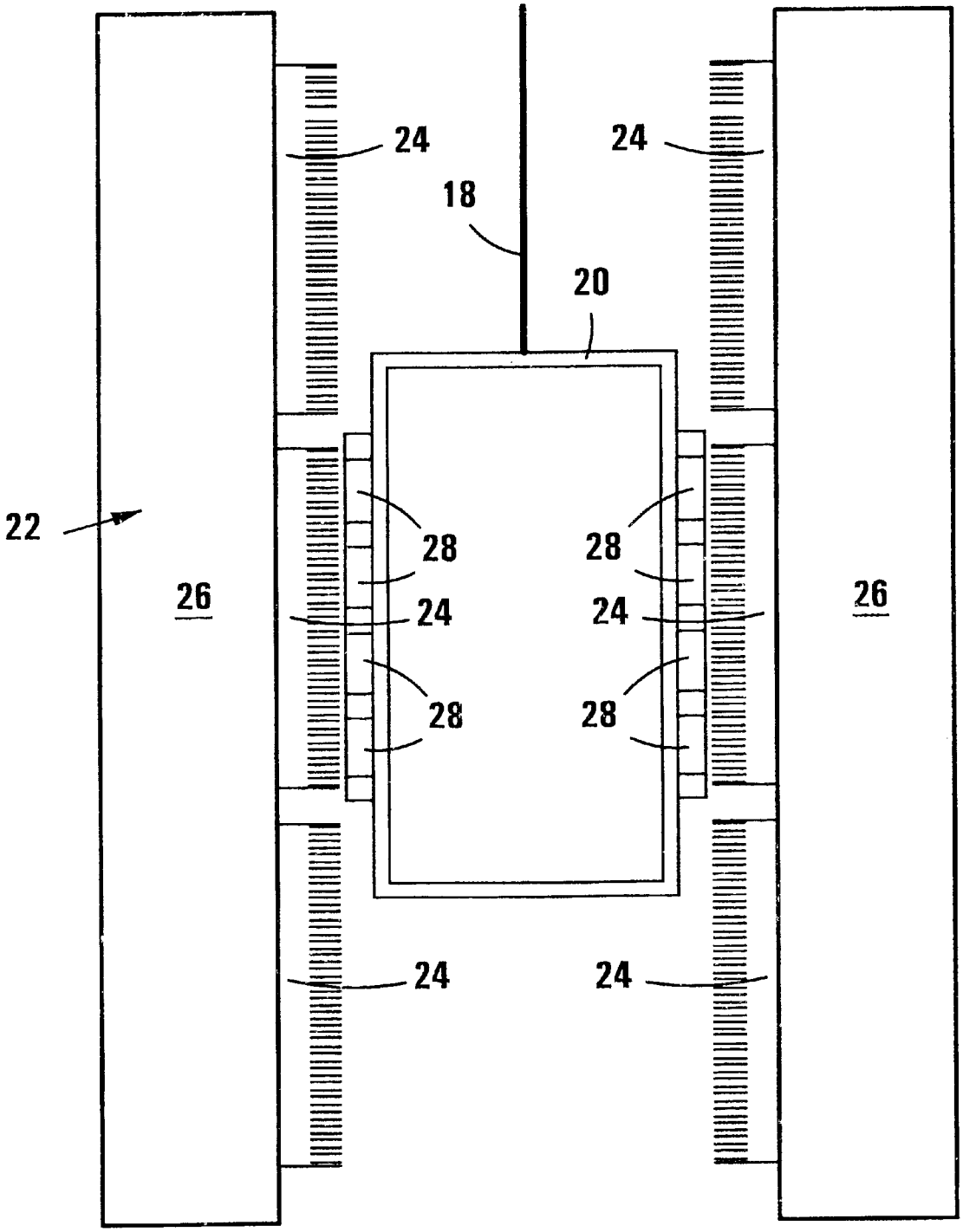

In the drawings,

FIG. 1 shows a pictorial view of a conveyance system in accordance with the invention; and FIG. 2 shows a cross-sectional view of a linear motor of the conveyance system of FIG. 1.

Figure 3:
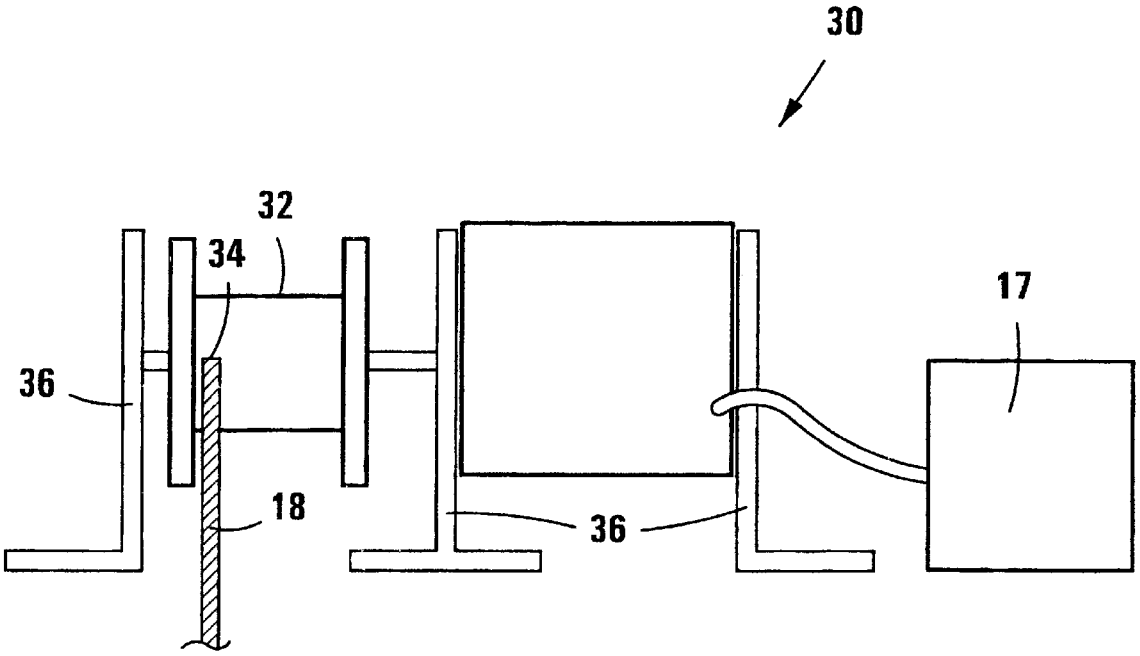

FIG. 3. is a schematic illustration, illustrating a winding means and cabled anchored at the upper end of the drum.

Referring to the drawings, reference numeral 10 generally indicates a conveyance system in accordance with the invention. The conveyance system 10 includes, in combination, a linear motor conveyance section 12 and a conventional hoist section 14. The conventional hoist section 14 includes conventional winding equipment 16 attached via a hoisting cable or rope 18 (see FIG. 2) to a conveyance in the form of a lift cage 20. In use, the system 10 functions exclusively as a conventional hoist in the hoist section 14 and in a hybrid fashion in the section 12 where the lift cage 20 is supported both by the cable 18 and a linear synchronous motor 22.

The linear synchronous motor 22 includes a conventional primary winding arrangement 24 mounted to guide means in the form of two spaced guide rails 26 (see FIGS. 1 and 2) which are mounted in use to walls of a mine shaft. The linear synchronous motor 22 further includes secondary permanent magnets 28 which, in use, interact with the primary winding arrangement 24 selectively to effect displacement or inhibit displacement of the lift cage 20 in a conventional fashion when the lift cage 20 is in the linear motor conveyance section 12.

The winding equipment 16 includes a controller 17 which is operable to control displacement of the lift cage 20 by means of the cable 18 in a conventional fashion when the lift cage 20 is in the conventional hoist section 14. In the conventional hoist section 14, the weight of the lift cage 20 and its load or cargo is supported by the cable 18. However, as the lift cage 20 descends from the conventional hoist section 14 into the linear motor conveyance section 12, the controller 17 activates the linear synchronous motor 22 thereby to bear at least some of the weight of the lift cage 20 and its cargo. The load borne by the linear synchronous motor 22 is gradually increased until it is totally supported by the linear synchronous motor 22. In this mode of operation, the cable 18 is only required to support its own weight and the winding equipment 16 is activated in such a fashion to take up any slack and retain a minimum amount of tension in the cable 18.

The controller 17 is operable to control the linear synchronous motor 22 in such a fashion so that the lift cage 20 may be decelerated as it approaches a terminal end of the mine shaft. Once the lift cage 20 is stationary, its cargo or load may be removed or replaced with further cargo, as the case may be. In order to displace the lift cage 20 towards the surface, the linear synchronous motor 22 is activated in a conventional fashion and the winding equipment 16 is activated to take up the slack in the cable 18. When the lift cage 20 approaches the conventional hoist section 14, the load of the cage 20 is gradually transferred from the linear synchronous motor 22 to the cable 18 whereafter the system 10 functions in a conventional manner.

In use, the linear synchronous motor 22 in combination with the conventional winding arrangement 16 is operable under control of the controller 17 to distribute the load of the lift cage 20 between the cable 18 and the linear synchronous motor 22. Accordingly, in the deeper regions of the shaft, the lift cage 22 may be supported by both the linear synchronous motor 22 and the cable 19, thereby reducing the diameter of the cable 18 required to support the lift cage 20 at such depths. Further, the linear synchronous motor 22 assists in braking the lift cage 20 as it descends, thereby reducing the stresses associated with braking on the cable 18. Further, in the event of the cable 18 failing, the linear synchronous motor 22 may be used as a back-up braking system for dynamically braking the lift cage 20.

Referring to FIG. 3, a winding means 30 is shown, which includes a drum 32 with the end 34 of the cable 18 anchored thereto. The winding means 30 is mounted proximate a ground surface of the shaft by mounting means 36. The winding means 30 and the linear motor 22 are controlled by the controller 17. A position that is between 75% and 80% down the mine shaft is shown by "A" in FIG. 1.

The Inventors believe that the invention, as illustrated, provides a conveyance system 10 with enhanced operating characteristics in that it includes advantages of both a conventional cable hoisting arrangement and a linear synchronous motor hoisting arrangement.

What is claimed is:

1. A deep-level mine shaft conveyance system which includes, a conveyance for conveying cargo;

a linear motor including a guide member carrying stator windings, the guide member being mounted in use in a mine shaft in its lower end region which is at a depth in excess of 1500 m, and a reaction member mounted to the conveyance for displacement along the guide member by electromagnetic forces;

a hoisting cable in excess of 1500 m in length and anchored at its lower end to the conveyance;

electrical winding means including a drum, the hoisting cable being anchored at its upper end to the drum and being wound and unwound around the drum to displace the conveyance along the mine shaft, the linear motor at least assisting displacement of the conveyance in the lower end region.

2. A system as claimed in claim 1, which includes two linear motors, reaction members of the linear motors being mounted on opposed sides of the conveyance and guide rails carrying stator windings associated with the reaction members being provided in use on opposed sides of the mine shaft.

3. A system as claimed in claim 2, in which the conveyance is shaped and dimensioned to convey personnel in underground mining operations and includes mounting means for mounting the winding means proximate a ground surface of the mine shaft and mounting the guide means along the mine shaft.

4. A system as claimed in claim 3, in which the winding means is configured for operation in single shaft deep mining applications.

5. A system as claimed in claim 3, in which the linear motor is a linear synchronous motor.

6. A system as claimed in claim 3, in which the guide means are in the form of guide rails which extend substantially vertically, when installed, at least along the lower end region of the mine shaft.

7. A system as claimed in claim 6, in which the linear motor is mounted along a lower end region of the guide rails.

8. A system as claimed in claim 3, which includes a controller for controlling operation of the linear motor and the winding means.

9. A system as claimed in claim 8, in which the controller is operable to disable the linear motor when the conveyance is above a predetermined position along the guide means.

10. A system as claimed in claim 9, in which the position is between 75% to 80% down the mine shaft.

11. A system as claimed in claim 9, in which the controller is operable to enable the linear motor and control operation of the winding means to reduce tension in the cable when the conveyance is below the predetermined position.

12. A system as claimed in claim 8, in which the controller is arranged to activate the linear motor at least to assist in braking the conveyance at substantial depth.

13. A system as claimed in claim 2, in which the linear motor includes a primary winding arrangement mounted along the guide means, and a secondary magnet arrangement mounted to the conveyance.

14. A method of reducing tension in a cable of a deep-level mine shaft conveyance system which includes electrical winding means to which the cable is anchored, the method including activating a linear motor mounted to guide rails and to a conveyance of the system at least partially to inhibit downward displacement of the conveyance and thereby reduce the tension in the cable.

* * * * *